US006240379B1

(12) United States Patent
Yin

(10) Patent No.: US 6,240,379 B1
(45) Date of Patent: May 29, 2001

(54) SYSTEM AND METHOD FOR PREVENTING ARTIFACTS IN AN AUDIO DATA ENCODER DEVICE

(75) Inventor: Lin Yin, Milpitas, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/220,320

(22) Filed: Dec. 24, 1998

(51) Int. Cl.[7] ..... G10L 21/02
(52) U.S. Cl. ..... 704/200.1; 704/229; 704/500
(58) Field of Search ..... 704/500, 501, 704/502, 503, 504, 229, 233, 222, 200, 230, 212, 200.1, 201

(56) References Cited

U.S. PATENT DOCUMENTS

| | | | | |
|---|---|---|---|---|
| 5,396,497 | | 3/1995 | Veltman | 370/100.1 |
| 5,481,543 | | 1/1996 | Veltman | 370/94.1 |
| 5,506,907 | | 4/1996 | Ueno et al. | 381/18 |
| 5,511,054 | | 4/1996 | Oishi et al. | 369/59 |
| 5,627,938 | * | 5/1997 | Johnston | 704/230 |
| 5,719,986 | | 2/1998 | Kato et al. | 386/109 |
| 5,732,391 | | 3/1998 | Fiocca | 704/229 |
| 5,764,698 | * | 6/1998 | Sudharsanan et al. | 375/241 |
| 5,832,445 | * | 11/1998 | Gao et al. | 704/501 |
| 5,987,407 | * | 11/1999 | Wu et al. | 704/224 |
| 6,006,179 | * | 12/1999 | Wu et al. | 704/222 |
| 6,041,295 | * | 3/2000 | Hinderks | 704/206 |

FOREIGN PATENT DOCUMENTS

| | | | |
|---|---|---|---|
| 0446031A2 | 9/1991 | (EP) | H04B/1/66 |
| 0805564A | 7/1992 | (EP) | H04B/1/66 |

* cited by examiner

*Primary Examiner*—Richemond Dorvil
(74) *Attorney, Agent, or Firm*—Gregory J. Koerner; Simon & Koerner LLP

(57) ABSTRACT

A system and method for preventing artifacts in an audio data encoder device comprises a filter bank for filtering source audio data to produce frequency sub-bands, a psycho-acoustic modeler for calculating signal-to-masking ratios for the source audio data, and a bit allocator for using the signal-to-masking ratios to assign a finite number of allocation bits to represent the frequency sub-bands. In the absence of a defined significant event, the bit allocator performs a sub-band forcing strategy, including a prebit allocation procedure, to prevent artifacts or discontinuities in the encoded audio data.

34 Claims, 7 Drawing Sheets

SYSTEM AND METHOD FOR PREVENTING ARTIFACTS IN AN AUDIO DATA ENCODER DEVICE

CROSS-REFERENCE TO RELATED APPLICATIONS

The present application is related to co-pending U.S. patent application Ser. No. 09/128,924, entitled "System And Method For Implementing A Refined Psycho-Acoustic Modeler," filed on Aug. 4, 1998, and to co-pending U.S. patent application Ser. No. 09/150,117, entitled "System And Method For Efficiently Implementing A Masking Function In A Psycho-Acoustic Modeler," filed on Sep. 9, 1998, and also to co-pending U.S. patent application Ser. No. 09/221394, entitled "System And Method For Effectively Implementing Fixed Masking Thresholds In An Audio Decoder Device," filed on Dec. 28, 1998, which are hereby incorporated by reference. The foregoing related applications are commonly assigned.

BACKGROUND OF THE INVENTION

1. Field of the Invention

This invention relates generally to signal processing systems, and relates more particularly to a system and method for preventing artifacts in an audio data encoder device.

2. Description of the Background Art

Implementing an effective and efficient method of encoding audio data is often a significant consideration for designers, manufacturers, and users of contemporary electronic systems. The evolution of modern digital audio technology has necessitated corresponding improvements in sophisticated, high-performance audio encoding methodologies. For example, the advent of recordable audio compact-disc devices typically requires an encoder-decoder (codec) system to receive and encode source audio data into a format (such as MPEG) that may then be recorded onto appropriate media using the compact-disc device.

Many portions of the audio encoding process are subject to strict technological standards that do not permit system designers to vary the data formats or encoding techniques. Other segments of the audio encoding process may not be altered because the encoded audio data must conform to certain specifications so that a standardized decoder device is able to successfully decode the encoded audio data. These foregoing constraints create substantial limitations for system designers that wish to improve the performance of an audio encoder device.

A paramount goal of most audio encoding systems is to encode the source audio data into an appropriate and advantageous format without introducing any sound artifacts generated by the audio encoding process. In other words, an audio decoder must be able to decode the encoded audio data for transparent reproduction by an audio playback system without introducing any sound artifacts created by the encoding and decoding processes.

Digital audio encoders typically process and compress sequential units of audio data called "frames". A particularly objectionable sound artifact called a "discontinuity" may be created when successive frames of audio data are encoded with non-uniform amplitude or frequency components. The discontinuities become readily apparent to the human ear whenever the encoded audio data is decoded and reproduced by an audio playback system.

Furthermore, to effectively encode audio data, the audio encoder must allocate a finite number of binary digits (bits) to the frequency components of the audio data, so that the encoding process achieves optimal representation of the source audio data. An efficient bit allocation technique that prevents discontinuity artifacts would thus provide significant advantages to an audio decoder device. Therefore, for all the foregoing reasons, an improved system and method are needed for preventing artifacts in an audio data encoder device.

SUMMARY OF THE INVENTION

In accordance with the present invention, a system and method are disclosed for preventing artifacts in an audio data encoder device. In one embodiment of the present invention, an encoder filter bank initially divides frames of received source audio data into frequency sub-bands. In the preferred embodiment, the filter bank preferably generates thirty-two discrete sub-bands per frame, and then provides the sub-bands to a bit allocator.

A psycho-acoustic modeler also receives the source audio data to responsively determine signal-to-masking ratios (SMRs), and then provide the SMRs to the bit allocator. Next, the bit allocator identifies the initial frame of sub-bands received from the filter bank, and then allocates a finite number of available allocation bits to selected sub-bands of the initial frame using a bit allocation process. The bit allocator then advances to a new current frame by moving forward one frame to arrive at the next frame of sub-bands provided from the filter bank.

Next, the bit allocator checks the new current frame for the presence of a significant event. In the preferred embodiment, the bit allocator detects a significant event whenever the difference in signal-to-masking ratios of successive frames (the current frame and the immediately preceding frame) exceeds a selectable threshold value. Other criteria for determining a significant event are likewise contemplated for use with the present invention If the bit allocator detects a significant event in the current frame, then the bit allocator performs the bit allocation process referred to above. However, if the bit allocator does not detect a significant event in the current frame, then, the bit allocator performs a prebit allocation procedure to form an initial sub-band set for the current frame. In one embodiment, the bit allocator preferably preallocates one bit per sample (from the available allocation bits) to each sub-band that was allocated bits in the immediately preceding frame to form the initial sub-band set for the current frame.

Then, the bit allocator performs the foregoing bit allocation process by allocating one bit per sample from the available allocation bits to the sub-band (from the initial sub-band set) with the highest SMR. Next, the bit allocator subtracts six decibels from the sub-band with the highest SMR that was just allocated the single bit. The bit allocator then determines whether any available allocation bits remain.

If available allocation bits remain, then the bit allocator continues to perform the bit allocation process for the current frame. However, if no available allocation bits remain, then the bit allocator determines whether any unprocessed frames of filtered audio data remain. If frames of filtered audio data remain unprocessed, then the bit allocator returns to process another frame of filtered audio data. However, if no frames of audio data remain, then the bit allocator has completed allocating bits to the audio data, and the foregoing bit allocation process terminates. The present invention thus efficiently and effectively perform a sub-band forcing strategy to implement a system and method for preventing artifacts in an audio data encoder device.

BRIEF DESCRIPTION OF THE DRAWINGS

FIG. 5(*b*) is a drawing for one embodiment of signal energy including discontinuities, in accordance with the present invention;

DETAILED DESCRIPTION OF THE PREFERRED EMBODIMENT

The present invention relates to an improvement in signal processing systems. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown, but is to be accorded the widest scope consistent with the principles and features described herein.

The present invention includes a system and method for preventing artifacts in an audio data encoder device that comprises a filter bank for filtering source audio data to produce frequency sub-bands, a psycho-acoustic modeler for calculating signal-to-masking ratios from the source audio data, and a bit allocator for using the signal-to-masking ratios to assign a finite number of allocation bits to represent the frequency sub-bands. In the absence of a defined significant event, the bit allocator performs a sub-band forcing strategy, including a prebit allocation procedure, to prevent artifacts or discontinuities in the encoded audio data.

Figure 1:
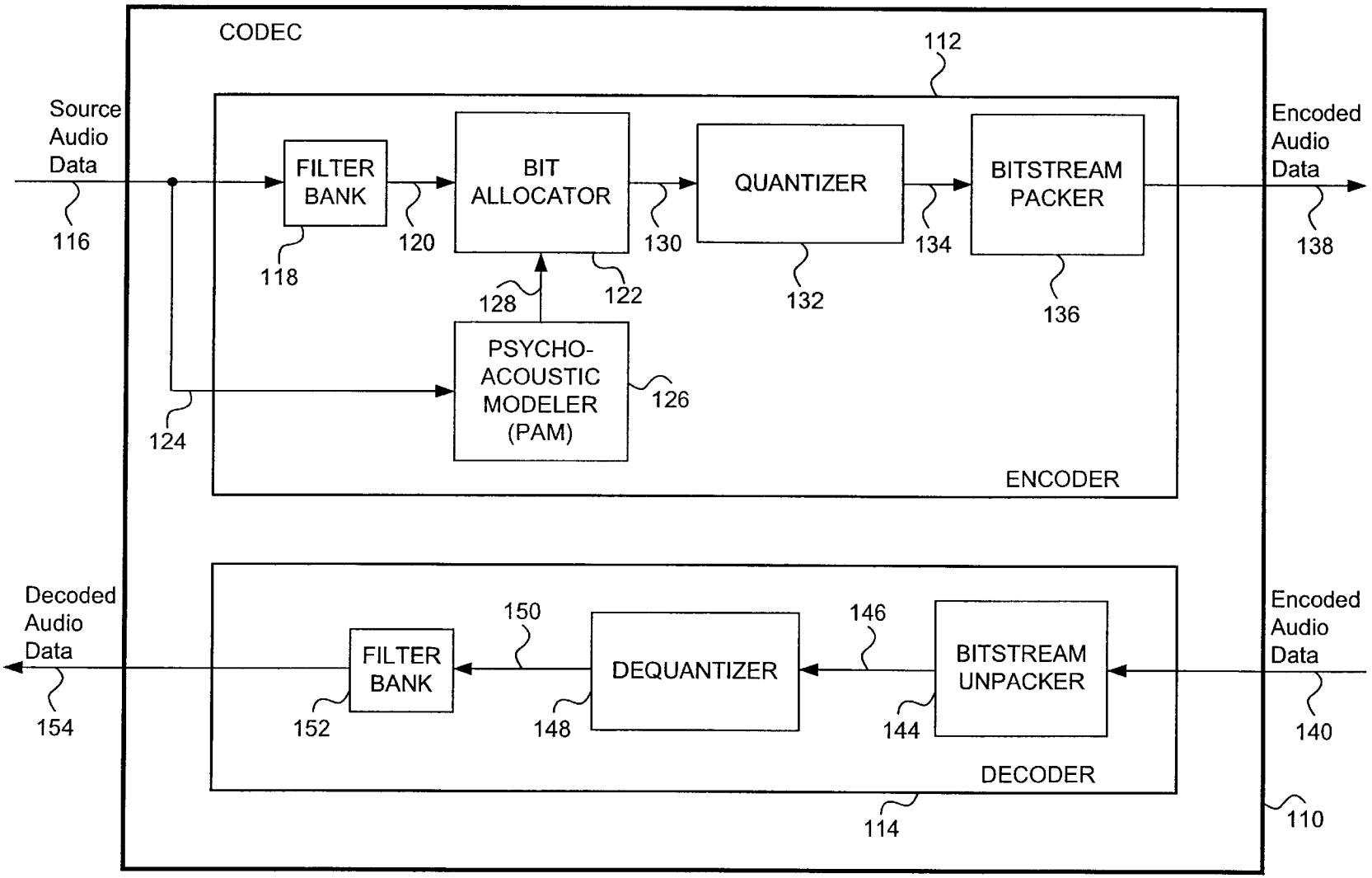
FIG. 1 is a block diagram for one embodiment of an encoder-decoder system, in accordance with the present invention.

Referring now to FIG. 1, a block diagram for one embodiment of an encoder-decoder (codec) 110 is shown, in accordance with the present invention. In the FIG. 1 embodiment, codec 110 comprises an encoder 112, and a decoder 114. Encoder 112 preferably includes a filter bank 118, a psycho-acoustic modeler (PAM) 126, a bit allocator 122, a quantizer 132, and a bitstream packer 136. Decoder 114 preferably includes a bitstream unpacker 144, a dequantizer 148, and a filter bank 152.

In the FIG. 1 embodiment, encoder 112 and decoder 114 preferably function in response to a set of program instructions called an audio manager that is executed by a processor device (not shown). In alternate embodiments, encoder 112 and decoder 114 may also be implemented and controlled using appropriate hardware configurations. The FIG. 1 embodiment specifically discusses encoding and decoding digital audio data, however the present invention may advantageously be utilized to process and manipulate other types of electronic information.

During an encoding operation, encoder 112 receives source audio data from any compatible audio source via path 116. In the FIG. 1 embodiment, the source audio data on path 116 includes digital audio data that is preferably formatted in a linear pulse code modulation (LPCM) format. Encoder 112 preferably processes 16-bit digital samples of the source audio data in units called "frames". In the preferred embodiment, each frame contains 1152 samples.

In practice, filter bank 118 receives and separates the source audio data into a set of discrete frequency sub-bands to generate filtered audio data. In the FIG. 1 embodiment, the filtered audio data from filter bank 118 preferably includes thirty-two unique and separate frequency sub-bands. Filter bank 118 then provides the filtered audio data (sub-bands) to bit allocator 122 via path 120.

Bit allocator 122 then accesses relevant information from PAM 126 via path 128, and responsively generates allocated audio data to quantizer 132 via path 130. Bit allocator 122 creates the allocated audio data by assigning binary digits (bits) to represent the signal contained in selected sub-bands received from filter bank 118. The functionality of PAM 126 and bit allocator 122 are further discussed below in conjunction with FIGS. 2–7.

Next, quantizer 132 compresses and codes the allocated audio data to generate quantized audio data to bitstream packer 136 via path 134. Bitstream packer 136 responsively packs the quantized audio data to generate encoded audio data that may then be provided to an audio device (such as a recordable compact disc device or a computer system) via path 138.

During a decoding operation, encoded audio data is provided from an audio device to bitstream unpacker 144 via path 140. Bitstream unpacker 144 responsively unpacks the encoded audio data to generate quantized audio data to dequantizer 148 via path 146. Dequantizer 148 then dequantizes the quantized audio data to generate dequantized audio data to filter bank 152 via path 150. Filter bank 152 responsively filters the dequantized audio data to generate and provide decoded audio data to an audio playback system (not shown) via path 154.

Figure 2:
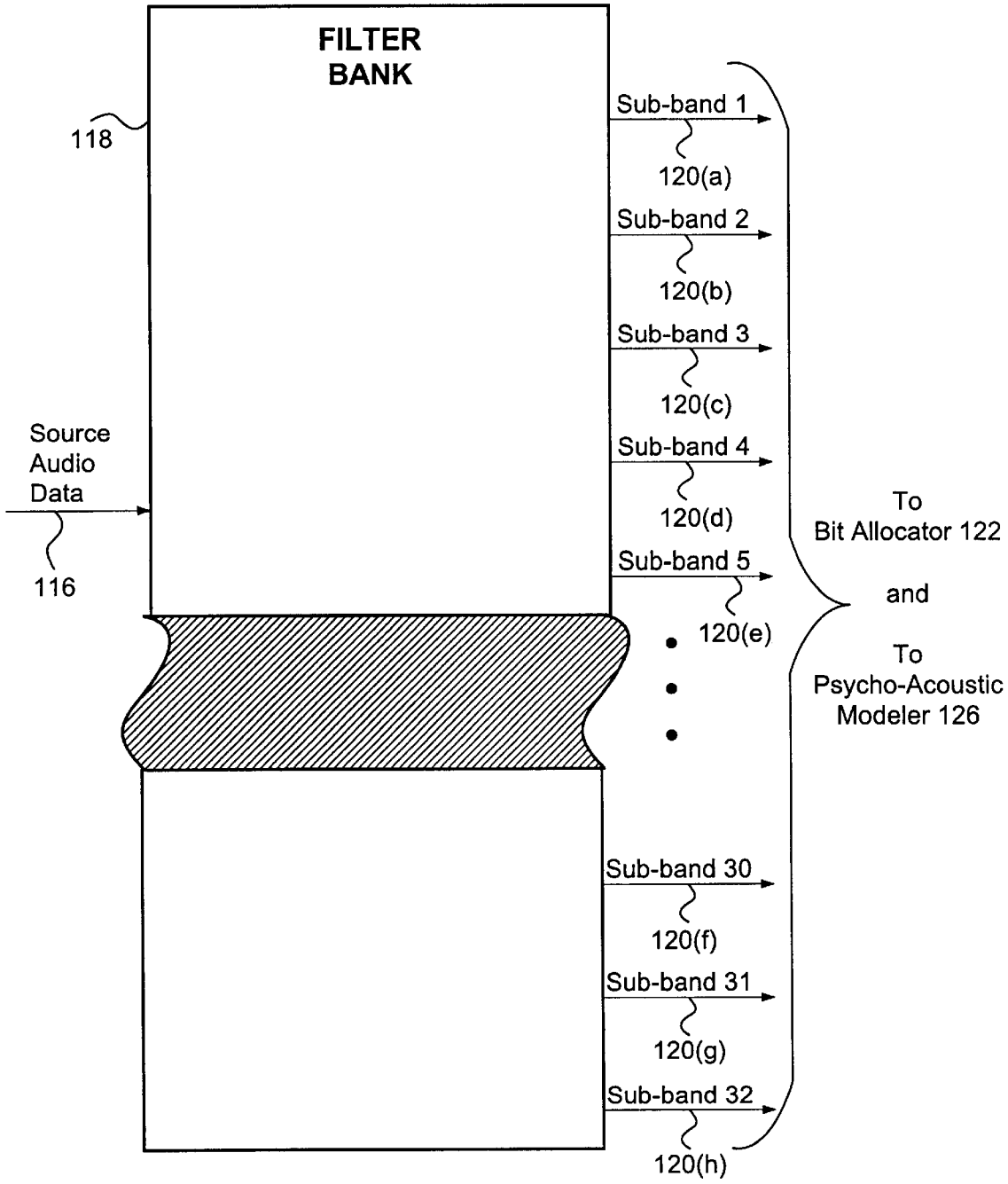
FIG. 2 is a block diagram for one embodiment of the encoder filter bank of FIG. 1, in accordance with the present invention.

Referring now to FIG. 2, a block diagram for one embodiment of the FIG. 1 encoder filter bank 118 is shown, in accordance with the present invention. In the FIG. 2 embodiment, filter bank 118 receives source audio data from a compatible audio source via path 116. Filter bank 118 then responsively divides the received source audio data into a series of frequency sub-bands that are each provided to bit allocator 122. The FIG. 2 embodiment preferably generates thirty two sub-bands 120(*a*) through 120(*h*), however, in alternate embodiments, filter bank 118 may readily output a greater or lesser number of sub-bands.

Figure 3:
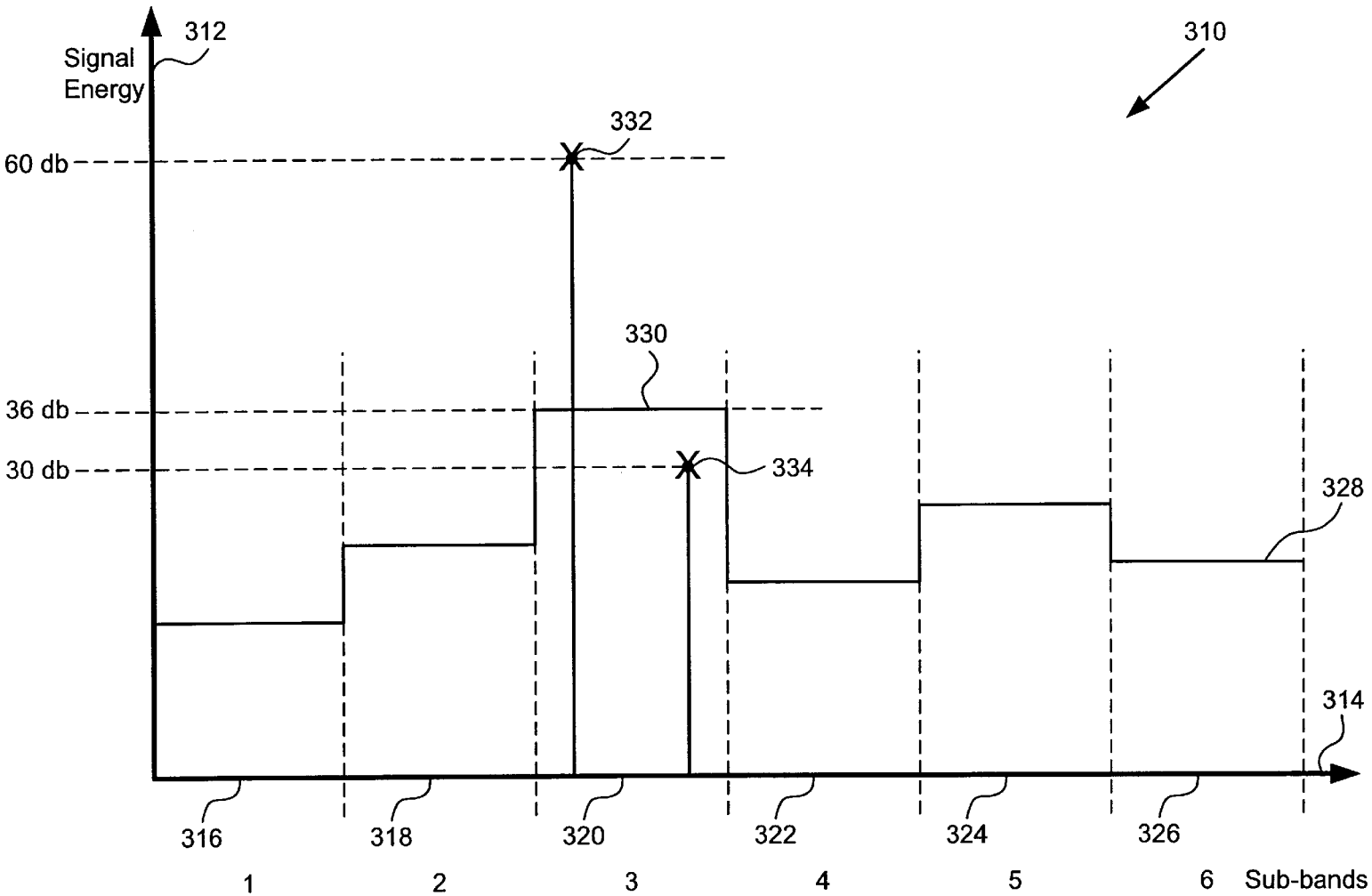
FIG. 3 is a graph for one embodiment of exemplary masking thresholds, in accordance with the present invention.

Referring now to FIG. 3, a graph 310 for one embodiment of exemplary masking thresholds is shown, in accordance with the present invention. Graph 310 displays audio data signal energy on vertical axis 312, and also displays a series of frequency sub-bands on horizontal axis 314. Graph 310 is presented to illustrate principles of the present invention, and therefore, the values shown in graph 310 are intended as examples only. The present invention may thus readily function with operational values other than those shown in graph 310 of FIG. 3.

In FIG. 3, graph 310 includes sub-band 1 (316) through sub-band 6 (326), and masking thresholds 328 that change for each FIG. 3 sub-band. Bit allocator 122 preferably receives sub-band 1 (316) through sub-band 6 (326) from filter bank 118, and also receives masking thresholds 328 from psycho-acoustic modeler 126. In operation, psycho-acoustic modeler (PAM) 126 receives the source audio data, frame by frame, and then utilizes characteristics of human hearing to generate the masking thresholds 328. Experiments have determined that human hearing cannot detect some sounds of lower energy when the lower energy sounds are close in frequency to a sound of higher energy.

For example, sub-band 3 (320) includes a 60 db sound 332, a 30 db sound 334, and a masking threshold 330 of 36 db. The 30 db sound 334 falls below masking threshold 330, and is therefore not detectable by the human ear, due to the masking effect of the 60 db sound 332. In practice, encoder 112 may thus discard any sounds that fall below masking thresholds 328 to advantageously reduce the amount of audio data and expedite the encoding process.

Psycho-acoustic modeler (PAM) 126 uses the signal energy levels, in the frequency domain, from the source audio data to calculate masking thresholds 328. PAM 126 may use various calculation methodologies to derive masking thresholds 328. For example, PAM 126 may alternately generate conventional masking thresholds, calculate an average masking threshold for each sub-band, use fixed masking thresholds, or produce special masking thresholds designed to improve performance of encoder 112. Calculating masking thresholds is discussed in co-pending U.S. patent application Ser. No. 09/128,924, entitled "System And Method For Implementing A Refined Psycho-Acoustic Modeler," filed on Aug. 4, 1998, and in co-pending U.S. patent application Ser. No. 09/150,117, entitled "System And Method For Efficiently Implementing A Masking Function In A Psycho-Acoustic Modeler," filed on Sep. 9, 1998, which are hereby incorporated by reference.

PAM 126 may then calculate a series of signal-to-masking ratios (SMRs) by dividing the signal energies of the sub-bands by the corresponding masking thresholds 328. Finally, PAM 126 provides the calculated SMRs to bit allocator 122 via path 128 so that bit allocator 122 may perform an efficient bit-allocation process to assign available allocation bits to the various sub-bands, in accordance with the present invention.

Figure 4:
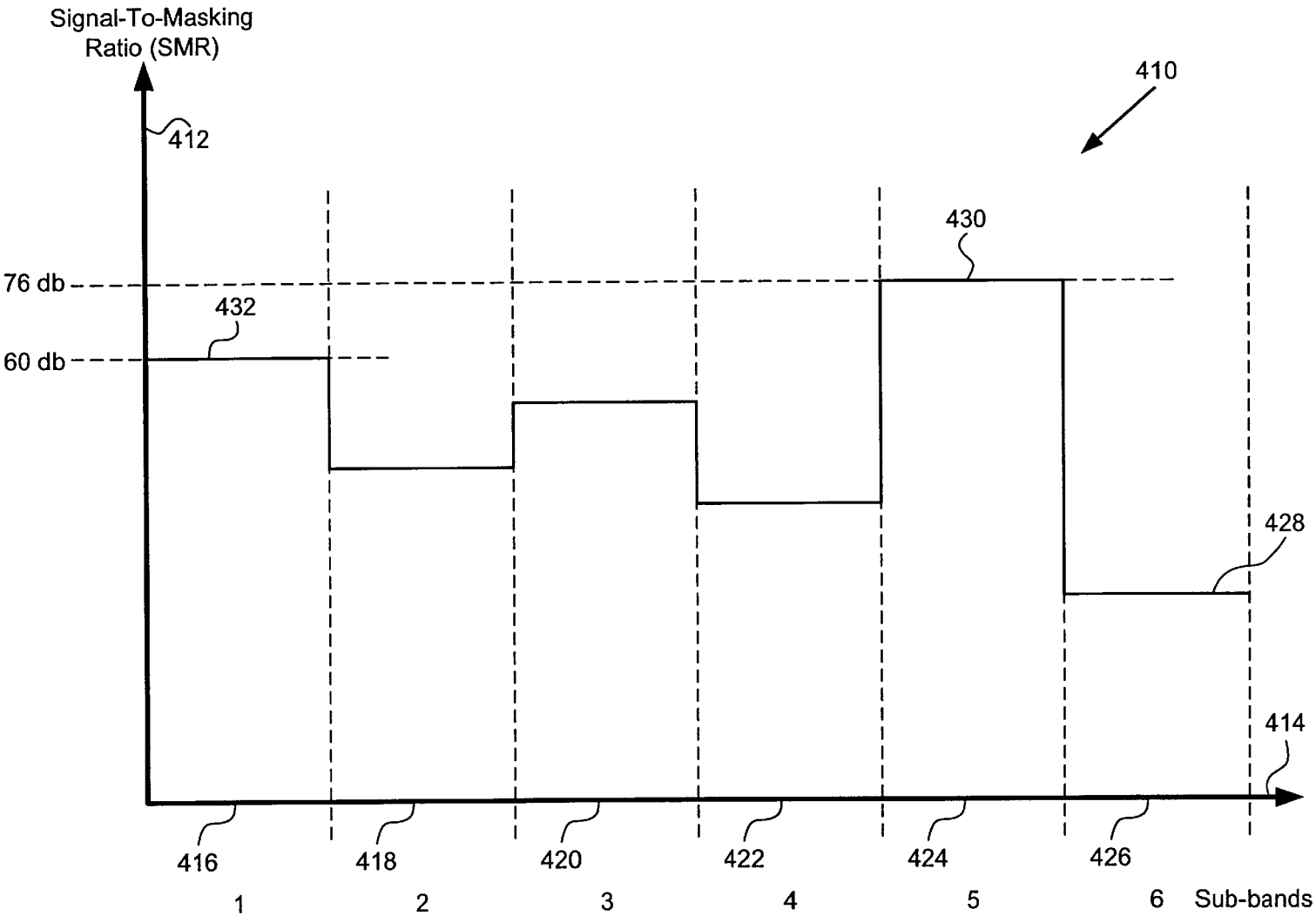
FIG. 4 is a graph for one embodiment of exemplary signal-to-masking ratios, in accordance with the present invention.

Referring now to FIG. 4, a graph 410 for one embodiment of exemplary signal-to-masking ratios (SMRs) is shown, in accordance with the present invention. Graph 410 displays SMR values on vertical axis 412, and also displays a series of frequency sub-bands on horizontal axis 414. Graph 410 is presented to illustrate principles of the present invention, and therefore, the values shown in graph 410 are intended as examples only. The present invention may thus readily function with operational values other than those presented in graph 410 of FIG. 4.

In FIG. 4, graph 410 includes sub-band 1 (416) through sub-band 6 (426), and SMR values 428 that change for each FIG. 4 sub-band. In operation, psycho-acoustic modeler (PAM) 126 provides the SMR values for each sub-band to bit allocator 122, which then responsively converts the filtered audio data into allocated audio data by performing a bit allocation process to allocate a finite number of available allocation bits to the frequency sub-bands. For example, bit allocator 122 may determine the total number of available allocation bits by dividing the bit rate by the sample rate, and then multiplying by the frame size. In one embodiment of the present invention, the bit rate preferably is 256,000 bits per second, and the sample rate is 48 kilohertz. If the frame size is 1152 bits per frame, then the total number of available allocation bits may therefore be calculated to be 6144 bits per frame.

In other words, bit allocator 122 must efficiently allocate a finite number of available bits to achieve optimal representation of the sub-bands received from filter bank 118 as filtered audio data. Bit allocator 122 may allocate the available bits using various allocation methods, such as allocating bits to certain frequency bands on a priority basis, or allocating bits in proportion to the relative signal energy of the sub-bands. In the preferred embodiment, bit allocator 122 allocates the available bits using a technique based on the sub-band SMRs received from psycho-acoustic modeler 126.

In practice, bit allocator 122 initially locates a maximum sub-band having the largest SMR, allocates one bit per sample to that maximum sub-band, and then subtracts 6 db from the maximum sub-band that was just allocated the single bit. Bit allocator 122 then continues to repeatedly allocate single bits and adjust the decibel value of the current maximum sub-band until no available bits remain.

For example, in graph 410 of FIG. 4, sub-band 5 (424) has the largest SMR 430 (76 db). Bit allocator 122 therefore initially allocates one bit to sub-band (424), and then subtracts 6 db from the SMR of 76 db to yield an adjusted SMR of 70 db. Since sub-band 5 (424) still has the largest SMR (70 db), bit allocator 122 then allocates a second bit to sub-band 5 (424) and subtracts another 6 db from the adjusted SMR of 70 db to yield an adjusted SMR of 64 db. Again, because sub-band 5 (424) still has the largest SMR (64 db), bit allocator 122 allocates a third bit to sub-band 5 (424) and subtracts another 6 db from the adjusted SMR of 64 db to yield an adjusted SMR of 58 db. Sub-band 1 (416) then becomes the sub-band having the largest SMR (60 db), so bit allocator 122 changes to sub-band 1 (416) to continues the foregoing bit allocation and level adjustment process. Bit allocator 122 continues to seek the sub-band with the largest SMR, and repeatedly allocates bits until all available bits have been allocated to selected sub-bands to produce allocated audio data. Bit allocator 122 then provides the allocated audio data to quantizer 132.

Figures 5A, 5B:
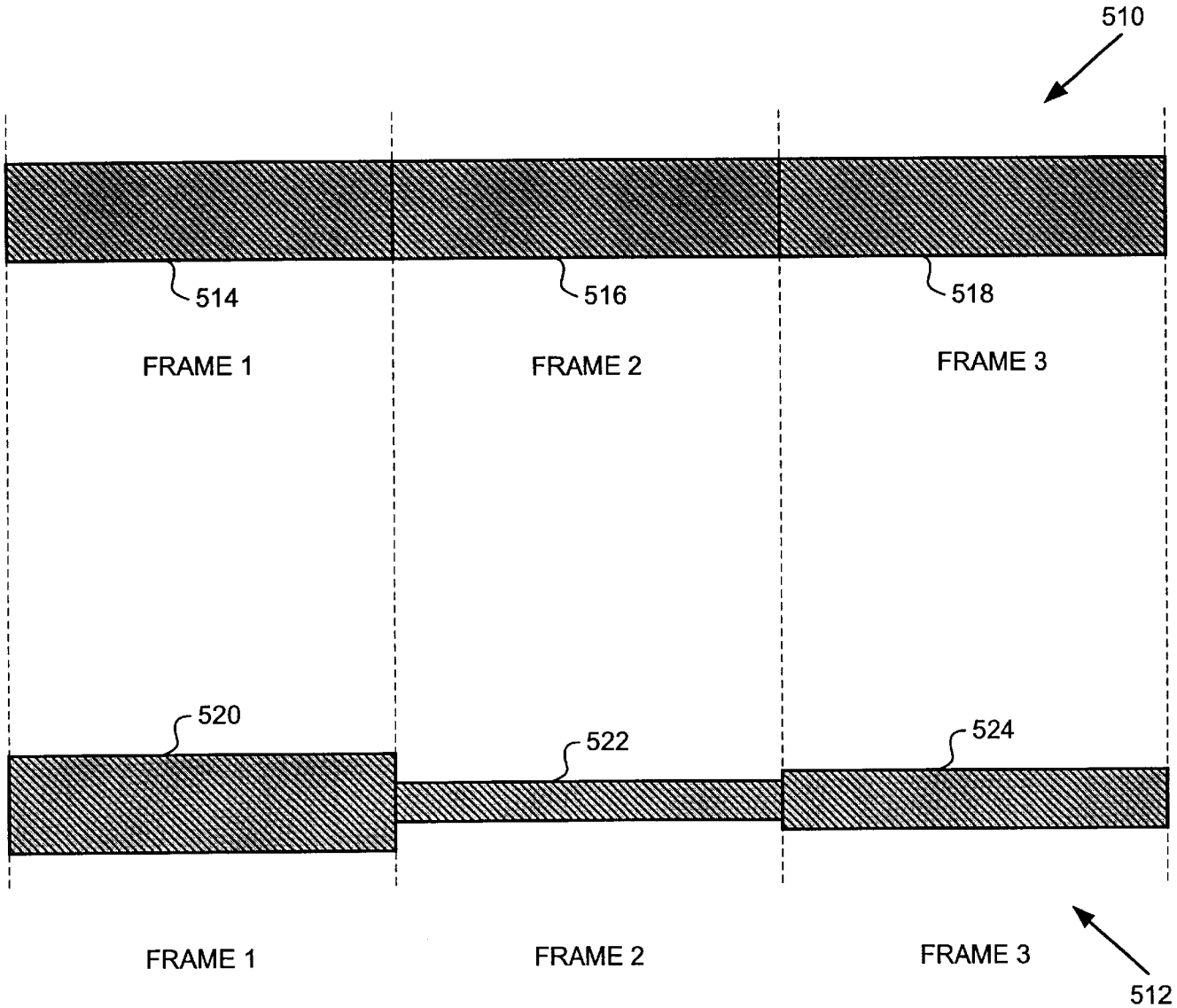
FIG. 5(*a*) is a drawing for one embodiment of signal energy without discontinuities, in accordance with the present invention.

Referring now to FIG. 5(*a*), a drawing for one embodiment of signal energy 510 without discontinuities is shown, in accordance with the present invention. FIG. 5(*a*) is presented to illustrate principles of the present invention, and therefore, signal energy 510 is intended as an example only. The present invention may thus readily function with signal energies other than those presented in FIG. 5(*a*).

In the FIG. 5(*a*) embodiment, signal energy 510 includes frame 1 (514), frame 2 (516), and frame 3 (518) that represent filtered audio data provided to bit allocator 122 by filter bank 118. In FIG. 5(*a*), frames 514 through 518 each include all sub-bands generated by filter bank 118, and therefore, the amplitude of frames 514 through 518 is relatively stable (without discontinuities).

Referring now to FIG. 5(*b*), a drawing for one embodiment of signal energy 512 including discontinuities is shown, in accordance with the present invention. FIG. 5(*b*) is presented to illustrate principles of the present invention, and therefore, signal energy 512 is intended as an example only. The present invention may thus readily function with signal energies other than those presented in FIG. 5(*b*).

In the FIG. 5(*b*) embodiment, signal energy 512 includes frame 1 (520), frame 2 (522), and frame 3 (524) that represent allocated audio data provided by bit allocator 122 to quantizer 132. In FIG. 5(*b*), due to the finite number of available allocation bits, frames 520 through 524 typically do not include all sub-bands generated by filter bank 118, and therefore, the amplitudes of frames 1 through 3 (520 through 524) are significantly different from the corresponding frames 1 through 3 (514 through 518) of FIG. 5(*a*).

For example, the signal energy of frame 2 (522) is substantially reduced in comparison to preceding frame 1 (520). An extended sequence of variations in signal energy (and related frequency components), such as that shown in frame 2 (522), operate to produce objectionable sound artifacts or discontinuities when the audio data is reproduced through an audio playback system. Compensating for such sound artifacts is further discussed below in conjunction with FIGS. 6 and 7.

Figure 6:
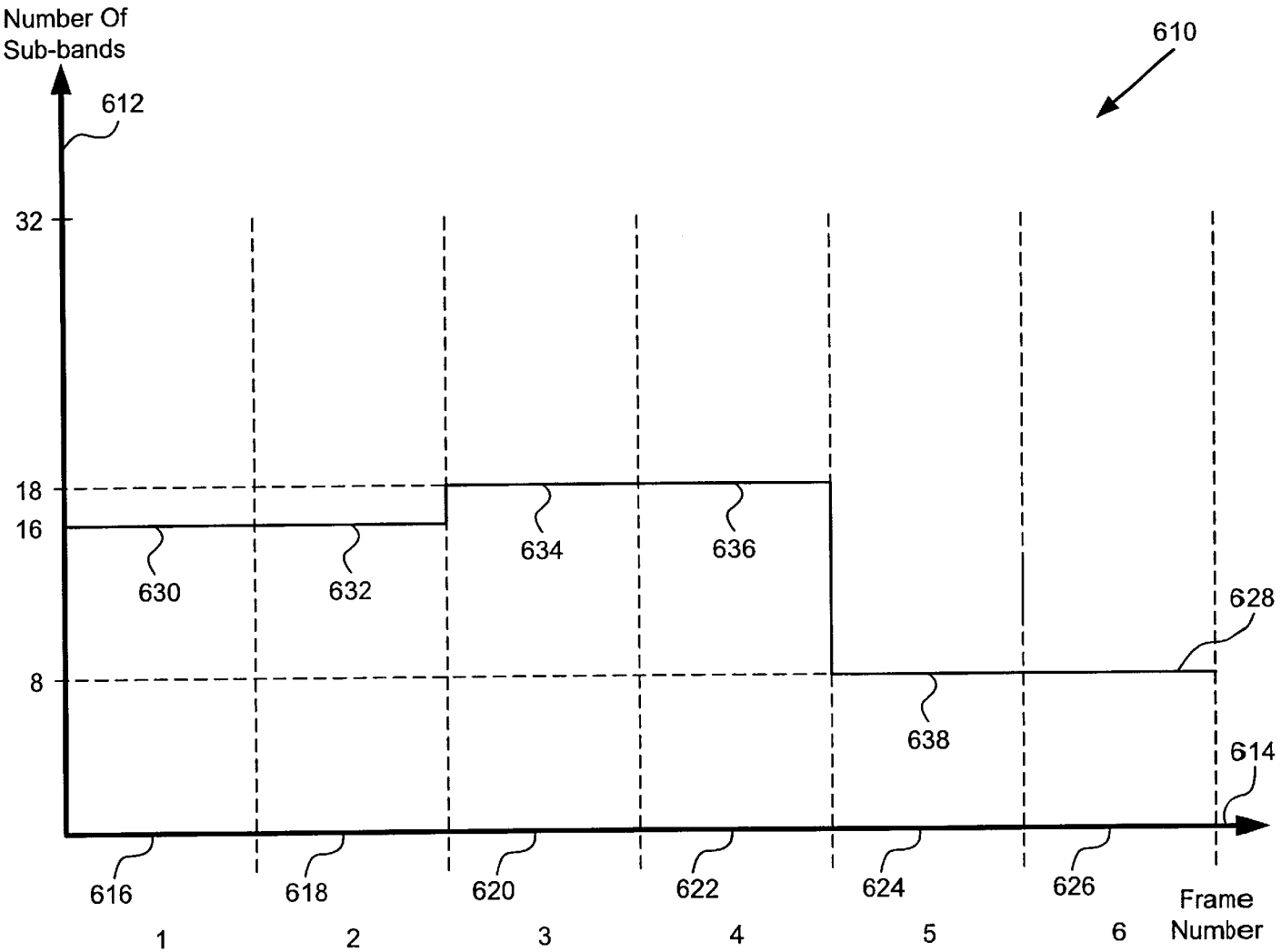
FIG. 6 is a graph of one embodiment for an exemplary sub-band forcing strategy, in accordance with the present invention.

Referring now to FIG. 6, a graph 610 of one embodiment for an exemplary sub-band forcing strategy is shown, in accordance with the present invention. Graph 610 displays the number of sub-bands allocated by bit allocator 122 on vertical axis 612, and also displays a sequence of audio data frames on horizontal axis 614. Graph 610 is presented to illustrate principles of the present invention, and therefore, the values shown in graph 610 are intended as examples only. The sub-band forcing strategy of present invention may thus readily function with operational values other than those presented in graph 610 of FIG. 6.

In FIG. 6, graph 610 includes frame 1 (616) through frame 6 (626), and the total number of allocated sub-bands 628 (which changes for each FIG. 6 frame). In operation, bit allocator 122 performs the FIG. 6 sub-band forcing strategy by initially calculating the number of sub-bands in frame 1 (616) using the bit allocation process described above in conjunction with FIG. 4. For example, in FIG. 6, bit allocator 122 allocates available bits resulting in sixteen sub-bands 630 for frame 1 (616).

Bit allocator 122 then analyzes frame 2 (618) for a significant event. Bit allocator 122 may determining a significant event using any desired and appropriate criteria. For example, the difference of total signal energy in successive frames may be compared to a threshold value. In the preferred embodiment, bit allocator 122 detects a significant event whenever the difference in the SMRs of successive frames is larger than a selectable threshold value.

In the FIG. 6 example, frame 2 (618) does not contain a significant event. Bit allocator 122 therefore performs a prebit allocation procedure to avoid substantial changes in the total number of sub-bands allocated to frame 2 (618). In the prebit allocation procedure, bit allocator 122 preferably allocates one bit to each of the sub-bands that were included in the previous frame (here, sixteen sub-bands 630 of frame 1 (616)) to form an initial sub-band set for the current frame 2 (618). In alternate embodiments, bit allocator 122 may similarly allocate a larger number or a percentage of the available allocation bits. In the absence of a significant event, the prebit allocation procedure thus stabilizes the number of sub-bands in successive frames. Bit allocator 122 then allocates the remaining available bits to the initial sub-band set of current frame 2 (618) using the bit allocation procedure discussed above in conjunction with FIG. 4.

In the event that bit allocator 122 detects a significant event, no prebit allocation procedure is performed, and bit allocator 122 allocates all of the available bits using the bit allocation procedure discussed above in conjunction with FIG. 4. In the FIG. 6 example, bit allocator 122 detects a significant event in frame 3 (620) and therefore allocates the available bits to produce eighteen sub-bands 634. In frame 4 (622), bit allocator 122 does not detect a significant event, and responsively performs the prebit allocation procedure to force eighteen allocated sub-bands 636.

In frame 5 (624), bit allocator 122 again detects a significant event, and therefore allocates the available bits to produce eight sub-bands 638. In frame 6 (626), bit allocator 122 does not detect a significant event, and responsively performs the prebit allocation procedure to maintain eight allocated sub-bands 636.

Figure 7:
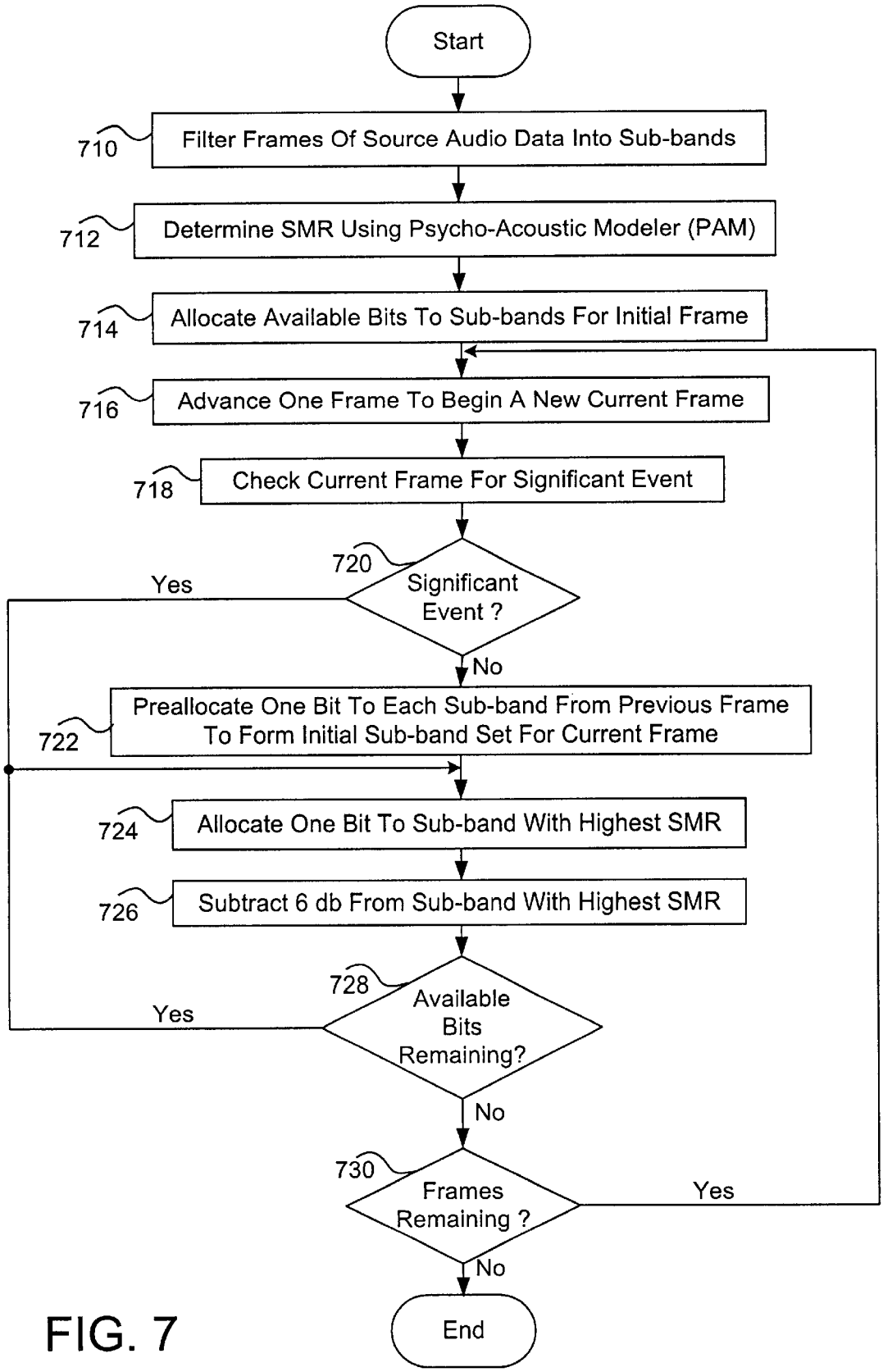
FIG. 7 is a flowchart of method steps for one embodiment of a system and method to prevent artifacts in an audio data encoder device, in accordance with the present invention.

Referring now to FIG. 7, a flowchart of method steps for one embodiment of a method to prevent artifacts is shown, in accordance with the present invention. Initially, in step 710, encoder filter bank 118 filters frames of received source audio data into frequency sub-bands to produce filtered audio data. In the preferred embodiment, filter bank 118 preferably generates thirty-two discrete sub-bands, and then provides the sub-bands as filtered audio data to bit allocator 122. In step 712, psycho-acoustic modeler 126 determines signal-to-masking ratios (SMRs) for the source audio data, and then provides the SMRs to bit allocator 122. The signal-to-masking ratios (SMRs) generated by PAM 126 are discussed above in conjunction with FIG. 3.

In step 714, bit allocator 122 identifies the initial frame of sub-bands received from filter bank 118, and then allocates all available bits to selected sub-bands from the initial frame. In the FIG. 7 embodiment, step 714 is preferably performed by executing a bit allocation process (shown in steps 724, 726, and 728 of FIG. 7), which is also discussed above in conjunction with FIG. 4.

In step 716, bit allocator 122 advances to a new current frame by moving forward one frame to arrive at the next frame of sub-bands provided from filter bank 118. Bit allocator 122, in step 718, then checks the new current frame for the presence of a significant event. In the preferred embodiment, bit allocator 122 detects a significant event whenever the difference in signal-to-masking ratios of successive frames (the current frame and the immediately preceding frame) exceeds a selectable threshold value. Other criteria for determining a significant event are discussed above in conjunction with FIG. 6.

In step 720, if bit allocator 122 detects a significant event, then the FIG. 7 process advances to step 724. However, if bit allocator 122 does not detect a significant event in the current frame, then, in step 722, bit allocator 122 advantageously performs a prebit allocation procedure to form an initial sub-band set for the current frame. In the FIG. 7 embodiment, bit allocator 122 preferably preallocates one bit (from the available allocation bits) to each sub-band that was included in the immediately preceding frame to form the initial sub-band set for the current frame.

Then, in step 724, bit allocator 122 allocates one bit from the available allocation bits to the sub-band (from the initial sub-band set) with the highest SMR. Next, in step 726, bit allocator 122 subtracts 6 db from the sub-band with the highest SMR (the allocated sub-band of step 724). In step 728, bit allocator 122 determines whether any available allocation bits remain.

If available allocation bits remain, then the FIG. 7 process returns to step 724. However, if no available allocation bits remain, then bit allocator 122 determines whether any unprocessed frames of filtered audio data remain. If no unprocessed frames remain, then bit allocator 122 has allocated bits to all the audio data, and the FIG. 7 process terminates. However, if frames remain in step 730, then the FIG. 7 flowchart returns to step 716 to process another frame of filtered audio data.

The invention has been explained above with reference to a preferred embodiment. Other embodiments will be apparent to those skilled in the art in light of this disclosure. For example, the present invention may readily be implemented using configurations and techniques other than those described in the preferred embodiment above. Additionally, the present invention may effectively be used in conjunction with systems other than the one described above as the preferred embodiment. Therefore, these and other variations upon the preferred embodiments are intended to be covered by the present invention, which is limited only by the appended claims.

What is claimed is:

1. A system for preventing artifacts, comprising:

a modeler configured to generate masking thresholds that correspond to filtered data, wherein said modeler and said bit allocator form part of an encoder device for encoding source audio data into encoded audio data, wherein said encoder device sequentially processes frames of said source audio data, said frames comprising data samples, and wherein a filter bank receives said frames, and responsively generates sub-bands for each of said frames; and a bit allocator that coverts said filtered data into allocated data by selectively assigning digital bits to represent sub-bands in said filtered data, wherein said artifacts are sound artifacts created by discontinuities between quantities of allocated sub-bands in said frames, and wherein said bit allocator performs a sub-band forcing strategy to eliminate said discontinuities.

2. The system of claim 1 wherein said source audio data is received in a linear pulse-code modulation format and is encoded by said encoder device to generate encoded audio data in an MPEG format.

3. The system of claim 1 wherein said sub-bands include thirty-two frequency sub-bands.

4. The system of claim 1 wherein said modeler is a psycho-acoustic modeler that determines said masking thresholds for said source audio data based on properties of human hearing.

5. The system of claim 4 wherein said masking thresholds represent signal energy levels below which said filtered data is not processed by said bit allocator.

6. The system of claim 4 wherein said psycho-acoustic modeler provides signal-to masking ratios to said bit allocator, said signal-to masking thresholds being equal to signal energy values divided by said masking thresholds.

7. The system of claim 6 wherein said bit allocator assigns a finite number of available allocation bits to said sub-bands.

8. The system of claim 7 wherein said available allocation bits equal said data samples multiplied by a sample rate.

9. The system of claim 7 wherein said bit allocator assigns said available allocation bits to said allocated sub-bands by repeatedly locating a maximum signal-to-masking ratio sub-band, assigning one bit to said maximum signal-to-masking ratio sub-band, and subtracting six decibels from said maximum signal-to-masking ratio sub-band, until all said available allocation bits have been assigned to said sub-bands.

10. The system of claim 1 wherein said sub-band forcing strategy maintains said quantities of said allocated sub-bands between said frames, unless said bit allocator detects a significant event.

11. The system of claim 10 wherein said bit allocator detects said significant event whenever a difference of said quantities of said allocated sub-bands between said frames exceeds a selectable threshold value.

12. The system of claim 10 wherein said sub-band forcing strategy includes a prebit allocation procedure whenever said bit allocator fails to detect said significant event.

13. The system of claim 12 wherein said bit allocator performs said prebit allocation procedure by assigning one bit from said available allocation bits to each of said allocated sub-bands from an immediately preceding frame to form an initial sub-band set for a current frame.

14. The system of claim 13 wherein said bit allocator performs said prebit allocation procedure for said current frame and then repeatedly locates a maximum signal-to-masking ratio sub-band for said initial sub-band set, assigns one bit to said maximum signal-to-masking ratio sub-band, and subtracts six decibels from said maximum signal-to-masking ratio sub-band, until all said available allocation bits have been assigned to said sub-bands.

15. The system of claim 1 wherein said bit allocator generates allocated data to a quantizer, said quantizer responsively providing quantized audio data to a bitstream packer that then generates said encoded audio data.

16. A method for preventing artifacts, comprising the steps of:

generating masking thresholds with a modeler, said masking thresholds corresponding to filtered data, wherein said modeler and said bit allocator form part of an encoder device for encoding source audio data into encoded audio data, wherein said encoder device sequentially processes frames of said source audio data, said frames comprising data samples, and wherein a filter bank receives said frames, and responsively generates sub-bands for each of said frames; and converting said filtered data with a bit allocator to produce allocated data by selectively assigning digital bits to represent sub-bands in said filtered data, wherein said artifacts are sound artifacts created by discontinuities between quantities of allocated sub-bands in said frames, and wherein said bit allocator performs a sub-band forcing strategy to eliminate said discontinuities.

17. The method of claim 16 wherein said source audio data is received in a linear pulse-code modulation format and is encoded by said encoder device to generate encoded audio data in an MPEG format.

18. The method of claim 16 wherein said sub-bands include thirty-two frequency sub-bands.

19. The method of claim 16 wherein said modeler is a psycho-acoustic modeler that determines said masking thresholds for said source audio data based on properties of human hearing.

20. The method of claim 19 wherein said masking thresholds represent signal energy levels below which said filtered data is not processed by said bit allocator.

21. The method of claim 19 wherein said psycho-acoustic modeler provides signal-to masking ratios to said bit allocator, said signal-to masking thresholds being equal to signal energy values divided by said masking thresholds.

22. The method of claim 21 wherein said bit allocator assigns a finite number of available allocation bits to said sub-bands.

23. The method of claim 22 wherein said available allocation bits equal said data samples multiplied by a sample rate.

24. The method of claim 22 wherein said bit allocator assigns said available allocation bits to said allocated sub-bands by repeatedly locating a maximum signal-to-masking ratio sub-band, assigning one bit to said maximum signal-to-masking ratio sub-band, and subtracting six decibels from said maximum signal-to-masking ratio sub-band, until all said available allocation bits have been assigned to said sub-bands.

25. The method of claim 16 wherein said sub-band forcing strategy maintains said quantities of said allocated sub-bands between said frames, unless said bit allocator detects a significant event.

26. The method of claim 25 wherein said bit allocator detects said significant event whenever a difference of said quantities of said allocated sub-bands between said frames exceeds a selectable threshold value.

27. The method of claim 25 wherein said sub-band forcing strategy includes a prebit allocation procedure whenever said bit allocator fails to detect said significant event.

28. The method of claim 27 wherein said bit allocator performs said prebit allocation procedure by assigning one bit from said available allocation bits to each of said allocated sub-bands from an immediately preceding frame to form an initial sub-band set for a current frame.

29. The method of claim 28 wherein said bit allocator performs said prebit allocation procedure for said current frame and then repeatedly locates a maximum signal-to-masking ratio sub-band for said initial sub-band set, assigns one bit to said maximum signal-to-masking ratio sub-band, and subtracts six decibels from said maximum signal-to-masking ratio sub-band, until all said available allocation bits have been assigned to said sub-bands.

30. The method of claim 16 wherein said bit allocator generates allocated data to a quantizer, said quantizer responsively providing quantized audio data to a bitstream packer that then generates said encoded audio data.

31. A system for preventing artifacts, comprising:

means for generating masking thresholds corresponding to filtered data; and means for converting said filtered data to produce allocated data by selectively assigning digital bits to represent sub-bands in said filtered data.

32. A computer readable medium comprising program instructions for preventing artifacts by performing the steps of: generating masking thresholds with a modeler, said masking thresholds corresponding to filtered data, wherein said modeler and said bit allocator form part of an encoder device for encoding source audio data into encoded audio data, wherein said encoder device sequentially processes frames of said source audio data, said frames comprising data samples, and wherein a filter bank receives said frames, and responsively generates sub-bands for each of said frames; and converting said filtered data with a bit allocator to produce allocated data by selectively assigning digital bits to represent sub-bands in said filtered data, wherein said artifacts are sound artifacts created by discontinuities between quantities of allocated sub-bands in said frames, and wherein said bit allocator performs a sub-band forcing strategy to eliminate said discontinuities.

33. The computer-readable medium of claim 32 wherein said modeler and said bit allocator are controlled by an audio manager program.

34. The computer-readable medium of claim 32 wherein said audio manager program is executed by a processor device.

* * * * *